United States Patent [19]

Pattyn et al.

[11] 4,008,089

[45] Feb. 15, 1977

[54] DIRECT-POSITIVE SILVER HALIDE EMULSION REDUCTION AND GOLD FOGGED IN CONTACT WITH A PALLADIUM COMPOUND

[75] Inventors: Herman Alberik Pattyn, Kapellen; Willy Joseph Vanassche, Kontich; Luc Achiel De brabandere, Mortsel, all of Belgium

[73] Assignee: AGFA-GEVAERT N.V., Mortsel, Belgium

[22] Filed: Mar. 24, 1975

[21] Appl. No.: 561,656

[30] Foreign Application Priority Data

Apr. 3, 1974 United Kingdom ..... 14800/74

[52] U.S. Cl. ..... 96/108; 96/94 R; 96/95; 96/101

[51] Int. Cl.[2] ..... G03C 1/28

[58] Field of Search ..... 96/101, 108, 94 R, 95

[56] References Cited

UNITED STATES PATENTS

| | | | |
|---|---|---|---|
| 2,717,833 | 9/1955 | Wark | 96/108 |
| 3,501,305 | 3/1970 | Illingsworth | 96/108 |
| 3,672,903 | 6/1972 | Chang | 96/108 |
| 3,752,674 | 8/1973 | Pritchett | 96/108 |
| 3,865,596 | 2/1975 | Furuya et al. | 96/108 |

*Primary Examiner*—Won H. Louie, Jr.
*Attorney, Agent, or Firm*—A. W. Breiner

[57] ABSTRACT

Reduction and gold fogged direct-positive Lippmann-emulsions have improved gradation and higher maximum density when fogging occurs in the presence of a palladium compound.

9 Claims, No Drawings

DIRECT-POSITIVE SILVER HALIDE EMULSION REDUCTION AND GOLD FOGGED IN CONTACT WITH A PALLADIUM COMPOUND

The present invention relates to direct-positive silver halide emulsions comprising fogged silver halide grains and to methods for the preparation of these emulsions.

It is known that direct-positive images can be obtained with certain types of photographic silver halide emulsions without previously forming a negative silver image. For example, the silver halide grains can be fogged during or after coating on a support by an overall exposure to actinic radiation or by overall chemically fogging e.g. by means of reducing agents. Upon image-wise exposure of the prefogged emulsions the development centres formed by said fogging are destroyed at the exposed areas and remain at the unexposed areas. By development of the emulsion after image-wise exposure a direct-positive image is formed.

Particularly suitable direct-positive silver halide emulsions are emulsions comprising fogged silver halide grains and electron-traps. The emulsions may comprise interior electron-traps or exterior electron traps.

Fogged direct-positive silver halide emulsions with interior electron traps are emulsions comprising silver halide grains having in their interior centres promoting the deposition of photolytic silver and an outer region of fogged silver halide. Fogged direct-positive silver halide emulsions with exterior electron-traps are emulsions having adsorbed to the surface of the fogged silver halide grains a compound accepting electrons e.g. electron-accepting dyes which may provide spectral sensitization or not.

It is known that by the use during reduction sensitization to fog of compounds of a metal more electropositive than silver, especially gold compounds, a remarkable increase of the sensitivity and maximum density is obtained so that the time of reduction fogging can be reduced or less drastic conditions of reduction fogging are needed.

The gold compounds however have also an influence on the gradation of the emulsion in such a way that a softer gradation, especially in the toe of the characteristic curve, is obtained as the concentration of gold compound is increased. This may be disadvantageous where high contrast is desirable especially in the highlight areas.

Although it is generally possible to limit the amount of gold compound so as to obtain the desired speed and contrast even in the highlight areas, special difficulties are encountered with very fine grain silver halide emulsions such as Lippmann emulsions having an average silver halide grain size of less than 100 nm. As a matter of fact, as is described in the co-pending application Ser. No. 561,658 filed on even date herewith for "Direct-positive silver halide Lippmann emulsions" it is preferred to use relatively large amounts of gold compound in uniformly fogging Lippmann-emulsions so that the characteristic curve of the direct-positive Lippmann-emulsion have soft gradation in the toe which is not desirable for these types of emulsion.

It has now been found that increased gradation, especially in the toe of the characteristic curve which results in good detail rendering in the highlight areas, and increased maximum developable density are obtained without reducing the sensitivity of the emulsion when the silver halide grains are fogged by reduction sensitization in the presence of a gold compound as well as a palladium compound.

Though the invention can be successfully applied both to coarse as well as fine-grain silver halide emulsions it is of special interest for fogging Lippmann-emulsions where the amounts of gold compound used in uniformly fogging the silver halide grains to obtain the desired speed and maximum density result in reduced gradation in the toe of the characteristic curve.

The present invention therefore provides a direct-positive photographic silver halide emulsion layer comprising reduction and gold fogged silver halide grains wherein the silver halide grains have an average grain-size of less than 100 nm and have been fogged in the presence of a palladium compound.

Reduction fogging of the silver halide grains may occur by high pH and/or low pAg silver halide digestion conditions e.g. as described by Wood, J. Phot. Sci. 1 (1953) 163, or by treatment with reducing agents e.g. tin(II)salts which include tin(II)chloride, tin complexes and tin chelates of the (poly)amino(poly)carboxylic acid type as described in British Pat. No. 1,209,050 filed Dec. 27, 1967 by Agfa-Gevaert N.V., formaldehyde, hydrazine, hydroxylamine, sulphur compounds such as thiourea dioxide, phosphonium salts such as tetra (hydroxymethyl)-phosphonium chloride, polyamines such as diethylenetriamine, bis(p-aminoethyl)-sulphide and its water-soluble salts, etc.; preferred reducing agents are thiourea dioxide and tin(II)chloride.

Gold fogging may occur by means of any gold compound known for use in fogging photographic silver halide grains. Specific examples of gold fogging agents are potassium tetrachloroaurate, auric trichloride, potassium aurithiocyanate, etc. It is also possible to employ a mixture of a water-soluble gold compound e.g. auric trichloride and thiocyanates forming complexes with gold and having a solvent action on the silver halide grains e.g. alkali metal and ammonium thiocyanates.

The palladium compound used in accordance with the present invention may be a palladium salt or complex e.g. ammonium, potassium or sodium tetrachloropalladate, potassium tetracyanopalladate, potassium palladium dioxalate, bispalladium acetylacetonate, alkalimetal palladium thioketocomplexes, palladium mercapto-complexes, etc.

Fogging of the silver halide grains is preferably effected at neutral or higher pH-values e.g. a pH value of at least 6.5 and at a pAg-value below 9, preferably below 8.35.

As is outlined above reduction fogging is effected by digestion with a reducing agent or by digestion at high pH and/or log pAg values. Gold fogging, according to which developable silver nuclei formed by reduction sensitization are converted into developable silver-gold or gold nuclei preferably occurs by addition of a gold compound before or during reduction fogging. If a reducing agent is employed the silver halide may be fogged by using the reducing agent initially and subsequently using the gold compound. However, the reverse order of agents can be used or the reduction and gold fogging agents can be used simultaneously.

Generally, the gold compound is used in the range of about 0.001 to about 0.1 millimole preferably in the range from about 0.01 to 0.1 millimole per mole of silver halide. Potassium chloroaurate is a preferred gold fogging agent and is often used at concentrations in the range of about 0.5 mg to about 50 mg per mole of silver halide, preferably in the range of about 2 mg to about 20 mg per mole of silver halide.

In accordance with the present invention the reduction and gold fogging treatment of the silver halide emulsion occurs in the presence of a palladium compound. The palladium compound may be added before fogging starts or during fogging. It may be added before or after the gold compound or simultaneously with the gold compound. The concentrations at which the palladium compound is employed may vary between very wide limits dependent on the ratio of silver halide to hydrophilic colloid e.g. gelatin in the emulsion. The palladium compound itself has no fogging effect as is apparent from the examples hereinafter but traces of palladium compound used in the reduction-gold fogging are already effective. However, it is preferred to use a molar ratio of gold compound to palladium compound between about 10:1 and about 1:20.

According to a preferred embodiment of the present invention, the direct-positive emulsions are of the type comprising exterior electron-traps by adsorption to the surface of the silver halide grains of one or more electron-accepting or desensitizing compounds as described e.g. in the U.K. Patent Specification No. 723,019.

According to Sheppard et al J.Phys.Chem. 50 (1946) 210, Stanienda, Z.Phys.Chem. (NF) 32 (1962) 238, and Dähne, Wiss.Phot. (1969) 161, desensitizers are dyestuffs whose cathodic polarographic half-wave potential, measured against the calomel electrode, is more positive than −1.0 V. Such compounds have also been described in the U.S. Pat. Nos. 3,501,305, 3,501,306 and 3,501,307 all of Bernard D. Illingsworth issued Mar. 17, 1970. The compounds described in the German Patent Specification No. 1,153,246 filed Apr. 11, 1962 by Agfa A. G. and U.S. Pat. No. 3,314,796 of Johannes Götze, August Randolph and Oskar Riester issued Apr. 18, 1967 are also suitable for this purpose as well as imidazo-quinoxaline dyestuffs, e.g. those described in the Belgian Patent Specification No. 660,253 filed Feb. 25, 1965 by Kodak Co.

It is now well known to characterize these electron-accepting or desensitizing compounds by means of their polarographic half-wave potential. Electron acceptors suitable for use in the direct-positive silver halide emulsions of the present invention have an anodic polarographic half-wave potential and a cathodic polarographic half-wave potential that when added together give a positive sum. Methods of determining these polarographic half-wave potentials have been described, e.g., in the U.S. Pat. Nos. 3,501,310 of Bernard D. Illingsworth issued Mar. 17, 1970 and 3,531,290 of Roberta A. Litzerman issued Sept. 29, 1970.

The electron-accepting compounds preferably have spectrally sensitizing properties although it is possible to use electron-accepting compounds that do not spectrally sensitize the emulsion.

The silver halide emulsions used in the direct-positive photographic materials of the present invention are emulsions of the Lippmann type which means that their average grain-size is less than 100 nm, preferably less than 80 nm. The silver halide Lippmann emulsions may be prepared according to methods well known in the art and described in the literature (see e.g. P. Glafkidès, "Photographic Chemistry", Vol. I, 1958, pages 365–368, Mees/James "The theory of the Photographic Process", 1966, p.36 and National Physical Laboratory "Notes on Applied Science" no.20: "Small Scale Preparation of Fine-Grain (Colloidal) Photographic Emulsions", B. H. Crawford, London, 1960). They may also be prepared according to the technique described in French Patent Publication 2,092,505.

Various silver salts may be used as the light-sensitive salt e.g. silver bromide, silver bromoiodide, silver bromochloride and silver bromochloroiodide but it is preferred to use silver halides predominantly consisting of silver bromide e.g. silver bromide emulsions which may have a silver iodide content of at most 8 mole %.

In the preparation of the direct-positive photographic silver halide emulsion for use in accordance with the present invention gelatin is preferably used as vehicle for the silver halide grains. However, the gelatin may be wholly or partly replaced by other natural hydrophilic colloids, e.g. albumin, zein, agar-agar, gum arabic, alginic acid, and derivatives thereof e.g. salts, amides and esters, starch and derivatives thereof, cellulose derivatives e.g. cellulose ethers, partially hydrolyzed cellulose acetate, carboxymethyl cellulose, etc. or synthetic hydrophilic resins, for example polyvinyl alcohol, polyvinyl pyrrolidone, homo- and copolymers of acrylic and methacrylic acid or derivatives e.g. esters, amides and nitriles, vinyl polymers e.g. vinyl ethers and vinyl esters.

The direct-positive silver halide emulsions for use in accordance with the present invention may comprise additional additives known to be beneficial in photographic emulsions. They may comprise e.g. speed-increasing compounds, stabilizers, antistatic agents, coating aids, optical brightening agents, light-absorbing dyes, plasticizers and the like.

Spectrally sensitizing dyes that are not electron-accepting such as e.g. cyanines, merocyanines, complex (trinuclear) cyanines, complex (trinuclear) merocyanines, styryls, and hemicyanines may also be present in the emulsion.

The silver halide emulsion layer and other hydrophilic colloid layers of a direct-positive photographic material employed in accordance with the present invention may be hardened by means of organic or inorganic hardeners commonly employed in photographic silver halide elements, e.g. the aldehydes and blocked aldehydes such as formaldehyde, dialdehydes, hydroxyaldehydes, mucochloric and mucobromic acid, acrolein, glyoxal, sulphonyl halides and vinyl sulphones, etc.

The sensitivity and stability of the direct-positive silver halide emulsions can be improved by coating the emulsions on the support at reduced pH value, preferably a pH of about 5, and/or at increased pAg value, preferably a pAg value which corresponds to an EMF of +30 mV or less (silver against saturated calomel electrode) as described in British Patent Application 32889/72.

Development of the exposed direct-positive silver halide emulsions of the invention may occur in alkaline solutions containing conventional developing agents such as hydroquinones, catechols, aminophenols, 3-pyrazolidinones, phenylenediamines, ascorbic acid and derivatives, hydroxylamines, etc. or combinations of developing agents.

Development may occur by means of a combination of developing agents that have a superadditive action, e.g. hydroquinone together with N-methyl-p-aminophenol sulphate or other p-aminophenol derivatives and hydroquinone or a p-phenylenediamine colour developing agent together with 1-phenyl-3-pyrazolidinone or other 3-pyrazolidinone derivatives.

The direct-positive silver halide emulsions can be coated on one or both sides of a wide variety of supports, which include opaque supports e.g. paper and metal supports as well as transparent supports e.g. glass, cellulose nitrate film, cellulose ester film, polyvinyl acetal film, polystyrene film, polyethylene terephthalate film, polycarbonate film and other films of resinous materials. It is also possible to use paper coated with α-olefin polymers e.g. paper coated with polyethylene, polypropylene, ethylenebutene copolymers etc.

Direct-positive silver halide emulsions of the Lippmann type are of particular importance for the preparation of photographic plates or films with high resolution, for use in microphotography and astrophotography, for recording nucleophysical phenomena, for the preparation of masks in the production of microelectronic integrated circuits, for use in holography, for high density data storage, etc.

In the manufacture of high resolution plate materials for the preparation of masks for use in the electronic industry, glass supports are most advantageously used in view of their high dimensional stability. In order to promote adhesion of the emulsion layer or an intermediate layer e.g. antihalation layer to glass supports in the preparation of high resolution plate materials, the silicon compounds described in British Pat. No. 1,286,467 can be incorporated into the emulsion layer or intermediate layer.

The following examples illustrate the present invention.

EXAMPLE 1

A monodisperse, cubic direct-positive silver bromoiodide emulsion (3 mole % of iodide) was prepared by the simultaneous addition of an aqueous solution of potassium bromide and potassium iodide and an aqueous solution of silver nitrate to a rapidly agitated aqueous gelatin solution over a period of about 15 minutes. The conditions of precipitation were adjusted so that a Lippmann emulsion with an average grain-size of about 70 nm was obtained.

The emulsion was chillset, shredded and washed with cold water whereupon gelatin was added. The emulsion comprised per kg an amount of silver halide corresponding to 75 g of silver nitrate and had a ratio of gelatin to silver halide, expressed as silver nitrate, of 0.6.

The emulsion was divided into several aliquot samples which were fogged by digestion for 90 min. at 57° C, pH 7 and pAg 8.18 in the presence of 0.07 mmol of thiourea dioxide and the amounts of gold and/or palladium compound listed in the following table per mole of silver halide.

After the addition per mole of silver halide of 2.38 g of pinacryptol yellow and 1.02 g of spectral sensitizer corresponding to the following formula:

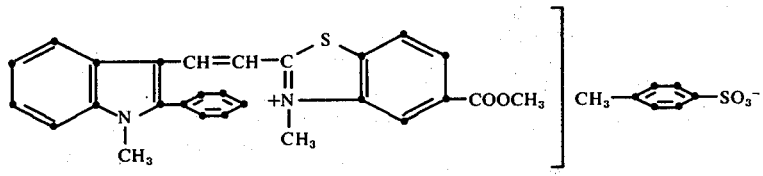

the pAg was adjusted to 9.68 and the pH to 5.

For comparison purposes palladium compound was added to two reduction and gold fogged emulsion samples just before coating instead of during digestion.

The emulsion portions were coated on a conventional support, dried, exposed in a sensitometer and developed for 3 min. at 20° C in a developer of the following composition:

| | |
|---|---|
| water | 800 ml |
| p-monomethyl-aminophenol sulphate | 1.5 g |
| hydroquinone | 6 g |
| anhydrous sodium sulphite | 50 g |
| anhydrous sodium carbonate | 32 g |
| potassium bromide | 2 g |
| ethylene diamine tetraacetic acid trisodium salt | 1.5 g |
| water to make | 1 liter |

After development, the materials were fixed, washed and dried in the usual manner. The sensitometric results are listed in the following table. The values of the speed are relative values for the speed measured at $(D_{max} - D_{min})/2$.

Table

| potassium tetrachloro aurate | ammonium tetrachloropalladate at fogging stage | ammonium tetrachloropalladate as coating final | $D_{min}$ | $D_{max}$ | rel. speed |
|---|---|---|---|---|---|
| — | — | — | 0.03 | 0.04 | — |
| — | 0.06 mmole | — | 0.03 | 0.04 | — |
| — | 0.12 mmole | — | 0.03 | 0.04 | — |
| 0.04 mmole | — | — | 0.03 | 4.75 | 87 |
| 0.04 mmole | 0.06 mmole | — | 0.04 | 4.85 | 91 |
| 0.04 mmole | 0.12 mmole | — | 0.04 | 5.30 | 79 |
| 0.02 mmole | — | — | 0.03 | 2.75 | 100 |
| 0.02 mmole | 0.06 mmole | — | 0.03 | 3.43 | 100 |
| 0.02 mmole | 0.12 mmole | — | 0.04 | 4.15 | 105 |
| 0.02 mmole | — | 0.06 mmole | 0.03 | 2.82 | 100 |
| 0.02 mmole | — | 0.12 mmole | 0.03 | 2.88 | 100 |

The above results show that whereas the palladium compound has no effect when used without gold compound in the fogging treatment, markedly increased maximum densities, with maintenance of approximately the same speed are obtained by the combined use of a gold compound and a palladium compound at the fogging stage. Addition of a palladium compound at a later stage gives only slight increases of maximum density.

It follows that by the use of a palladium compound at the fogging stage it is possible to reduce the amount of gold compound and nevertheless obtain same speed and maximum density.

The combined use of a gold compound and palladium compound results in increased contrast in the highlight areas as illustrated by the following example.

EXAMPLE 2

Emulsion samples were prepared as described in example 1 with the only difference that the thiourea dioxide was now used in an amount of 0.055 mmole per mole of silver halide.

The samples were further treated as described in Example 1 and the sensitometric results obtained are listed in the following table. The values given for the gamma in the toe ($\gamma_t$) of the characteristic curve are the average gradients measured over an exposure range between density 0.1 and 1 above $D_{min}$.

Table

| potassium tetrachloro aurate | ammonium tetra-chloro palladate (at fogging stage) | $D_{min}$ | $D_{max}$ | relative speed | $\gamma t$ |
|---|---|---|---|---|---|
| 0.02 mmole | — | 0.02 | 1.54 | 100 | 2.15 |
| 0.04 mmole | — | 0.03 | 3.80 | 115 | 2.00 |
| 0.06 mmole | — | 0.14 | >4.3 | 87 | 1.50 |
| 0.02 mmole | 0.06 mmole | 0.04 | 2.52 | 83 | 2.20 |
| 0.02 mmole | 0.12 mmole | 0.05 | 3.02 | 95 | 2.35 |
| 0.02 mmole | 0.18 mmole | 0.08 | 3.26 | 95 | 2.20 |

The above results show that with increasing amounts of gold compound increased $D_{max}$ is obtained but the $\gamma_t$ lowers. By the use of a palladium compound in combination with the gold compound, the amount of gold compound can be limited and favourable $D_{max}$ and sharper $\gamma_t$ can be obtained.

We claim:

1. A direct-positive silver halide emulsion comprising reduction and gold fogged silver halide grains wherein the grains have an average grain size of less than 100 nm and wherein a palladium compound was added to the silver halide emulsion at the time of fogging said silver halide grains being gold fogged with from about 0.001 to about 0.1 millimole of a gold compound per mole of silver halide.

2. A direct-positive silver halide emulsion according to claim 1 wherein the silver halide grains have adsorbed to their surface at least one compound the anodic and cathodic polarographic half-wave potentials of which are such that when added together they give a positive sum.

3. A direct-positive silver halide emulsion according to claim 1, wherein the silver halide grains are gold fogged by means of potassium tetrachloro aurate.

4. A direct-positive silver halide emulsion according to claim 1, wherein the silver halide grains are gold fogged with from about 0.5 mg and 50 mg of potassium tetrachloroaurate per mole of silver halide.

5. A direct-positive silver halide emulsion according to claim 1, wherein the molar ratio of gold compound to palladium compound is from about 10:1 and 1:20.

6. A direct-positive silver halide emulsion according to claim 1, wherein the palladium compound is ammonium, potassium or sodium tetrachloropalladate.

7. A direct-positive silver halide emulsion according to claim 1, wherein the reduction and gold fogging was effected by digestion with a reducing agent and a gold compound.

8. A direct-positive silver halide emulsion according to claim 1, wherein the reduction and gold fogging was effected by digestion at high pH and/or low pAg values in the presence of a gold compound.

9. A direct-positive silver halide emulsion according to claim 1, wherein the reducing agent for the reduction was thiourea dioxide or tin(II)chloride.

* * * * *